United States Patent [19]

Dorris

[11] 3,982,363

[45] Sept. 28, 1976

[54] FRANGIBLE INSERT

[75] Inventor: John P. Dorris, Newport Beach, Calif.

[73] Assignee: DDK Investments, Ltd., Fountain Valley, Calif.

[22] Filed: Oct. 18, 1974

[21] Appl. No.: 516,139

[52] U.S. Cl. ..... 52/98; 52/699; 249/96; 85/32 K; 85/35

[51] Int. Cl.[2] ..... E04C 5/16; E04C 5/00

[58] Field of Search ..... 52/98, 99, 100, 679, 52/688, 699, 700, 704, 705, 125, 706; 85/19, DIG. 2, 32 K, 35; 249/96, 97

[56] References Cited

UNITED STATES PATENTS

| | | | |
|---|---|---|---|
| 809,177 | 1/1906 | Drolshagen | 52/704 |
| 1,107,544 | 8/1914 | Ogden | 85/32 K |
| 1,573,151 | 2/1926 | Fishel | 52/700 |
| 1,613,800 | 1/1927 | Lehnert | 52/98 |
| 1,627,554 | 5/1927 | Fishel | 52/705 |
| 2,820,209 | 1/1958 | Whitted | 85/19 |
| 2,976,345 | 3/1961 | Whitted | 85/80 |
| 3,393,597 | 7/1968 | Hoaglund | 85/35 |
| 3,434,521 | 3/1969 | Flora | 85/35 |
| 3,685,783 | 8/1972 | Hilson | 249/97 |

FOREIGN PATENTS OR APPLICATIONS

| | | | |
|---|---|---|---|
| 715,775 | 8/1965 | Canada | 52/704 |
| 69,195 | 1969 | Germany | 52/699 |

*Primary Examiner*—Ernest R. Purser
*Assistant Examiner*—William Randolph
*Attorney, Agent, or Firm*—Harry W. F. Glemser

[57] ABSTRACT

An insert comprising a body to be embedded in concrete and having a prong smaller in size than said body, connected at one end to said body by a frangible neck. The prong has external ridges and is adapted to be driven by a hammer into an undersized opening in a mold to securely mount the insert in place. After the concrete has set, the prong is automatically broken off, i.e., separated from the embedded portion of the insert, as an incident to the stripping of the mold from the work.

9 Claims, 8 Drawing Figures

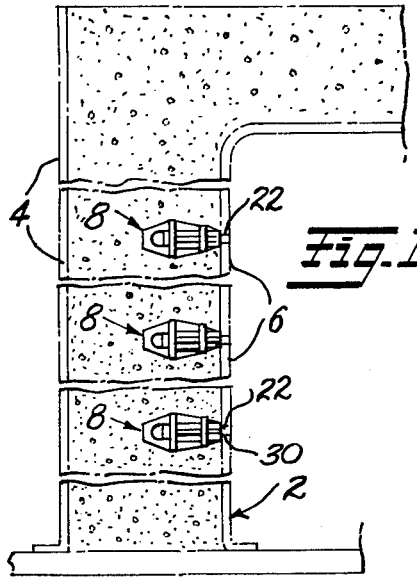
Fig. 1.
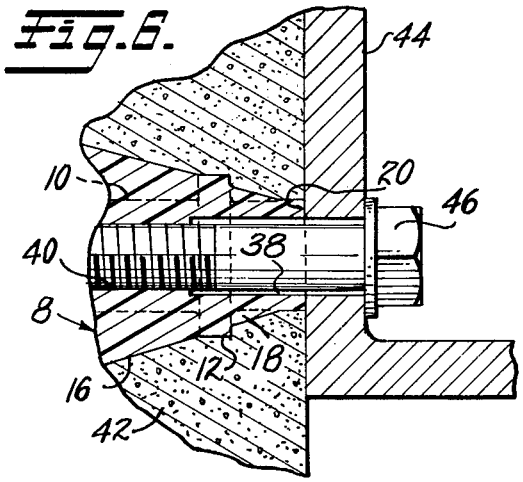
Fig. 6.
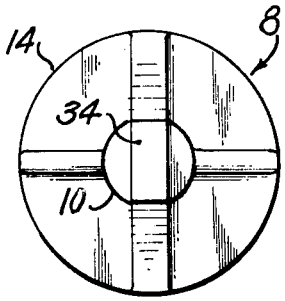
Fig. 3.
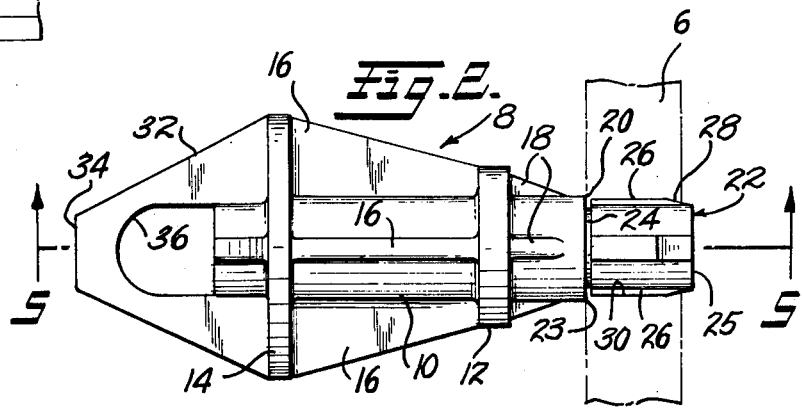
Fig. 2.
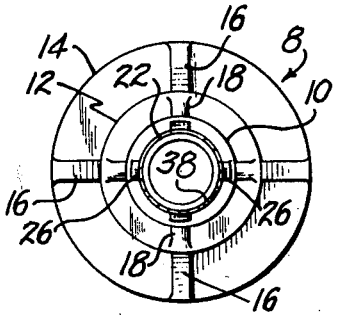
Fig. 4.
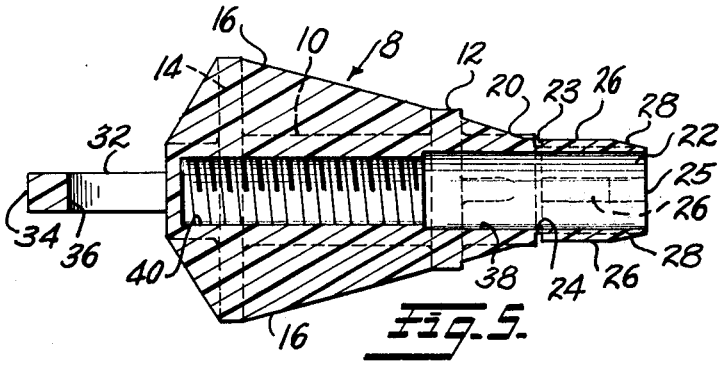
Fig. 5.
Fig. 8.
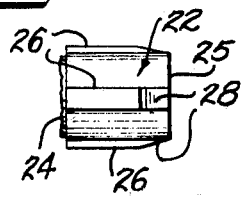
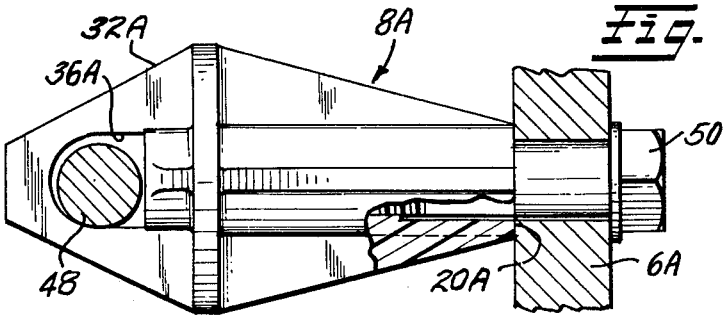
Fig. 7.

FRANGIBLE INSERT

BACKGROUND OF THE INVENTION

1. Field of the Invention

The present invention relates to a bolt-anchor, or insert, adapted to be embedded in concrete; and more particularly to an insert having a slightly compressible extension, or mounting prong, connected to one end thereof by an annular frangible portion.

2. The Prior Art

Numerous types of inserts have been heretofore devised for embedment in concrete, but many of these have the disadvantage that they require the use of nails, bolts or other fasteners to retain the insert in place during pouring of the concrete. Many of such inserts also require the use of tools to remove the fasteners to free the mold from the concrete casting.

One prior form of insert requires the cooperation of two workmen to mount the same on the wall of a large mold, one workman being required to hold the insert in place on one side of the mold, while the other workman, on the opposite side of the mold, is tightening a bolt to secure the insert in place. Moreover, such insert also requires the use of a wrench or other tool to unscrew the bolt to free the mold from the concrete after it has set; all of which involves considerable waste of time and labor.

A so-called dowel (screw-anchor), somewhat resembling the general appearance of the present insert, is disclosed in U.S. Pat. No. 809,177, but is designed to be permanently mounted in a preformed hole in a wall with its outer end flush with the surface of the wall.

Another prior insert (U.S. Pat. No. 1,114,013) includes a pin that has a head that is driven into an undersized opening in a mold board. Anchor means is attached to the inner end of the pin. This arrangement has the disadvantage that, after casting, a tool is required to remove the pin from the anchor means and from the mold board.

Another prior insert (U.S. Pat. No. 1,474,956) comprises a mounting plug that is fastened to the inner wall of a mold, and an insert that partially telescopes the plug and is fastened to the plug. In such situation, the mold must be disassembled or collapsed to remove the plug from the insert before the mold can be freed from the casting.

A further prior art insert (U.S. Pat. No. 3,685,783) embodies a frangible portion disposed between two threaded sections of a so-called dowel. One of the threaded sections is screwed into an anchor member and the other threaded section is screwed into a threaded opening in a mold. This requires the use of a tool for mounting the dowel in the anchor member and also to mount the dowel in the mold. A tool must be used to remove the portion of the insert remaining in the mold face after the frangible portion has been broken. A tool is also required to remove the threaded portion of the dowel remaining in the anchor means before anything can be fastened to the anchor member.

When the fact is considered that various concrete structures, building walls, etc., require a substantial number of bolt-anchoring inserts to be embedded therein, an enormous amount of time and labor is wasted in mounting the inserts in a mold and in subsequently freeing and removing the molds after the concrete sets.

SUMMARY OF THE INVENTION

The preferred form of the insert of the present invention avoids the foregoing objections and disadvantages of the prior art by providing an insert designed so that it can be securely mounted on the concrete side of a mold by one person without the use of any separate retaining elements such as nails, screws, bolts, etc., and which will enable the mold to be removed without complete collapsing or disassembly thereof.

More specifically, the preferred insert comprises a unitary, internally threaded body portion having a prong extending from one end thereof and joined thereto by a thin frangible neck or breakaway ring. The prong is designed to be driven into an undersized opening in a mold by the use of a hammer, and to automatically break off as the mold is being stripped from the work. The prong has external ridges that facilitate entry into the mold opening, and securely retain the insert in place on the concrete side of the mold. The body portion has on its exterior one or more transverse pull-out resistant flanges, and longitudinal reinforcing ribs. A sturdy web on the inner end of the insert serves as a head to receive hammer blows during driving of the prong into the opening in the mold.

The insert can also be used without the prong; wherefore, it is designed so that the prong can be easily removed from the body portion of the insert before mounting on a mold wall. The insert can then be secured in place by a bolt, particularly in instances where the insert is utilized to support a heavy reinforcing bar within the mold.

Accordingly, the principal object of the invention is to provide an anchor type insert that can be mounted on the concrete side of a mold in a minimum of time and labor, thereby effecting substantial savings in production costs.

Another object is to provide an insert that is simple in construction, easy to manufacture, and mountable in a mold with a minimum of effort. In this connection, the term "mold" as used herein is intended to include wooden and metal molds used in making underground vaults, etc., as well as wooden or metal forms, mold boards, etc., used in constructing concrete building side walls, ceilings, foundations, etc.

Still another object is to provide an insert designed so that it can be mounted in a mold by one person using only a hammer.

A further object is to provide an insert that can be mounted in a mold without the use of any separate fastening elements, and which will enable the mold to be removed from the work without complete collapsing or disassembly of the mold.

A still further object is to provide an insert with a mounting prong constructed so that it is slightly compressible to enable the same to be driven into an opening of relatively smaller size than that of the prong.

A more specific object is to provide an insert having a prong portion that is connected to the body of the insert by a frangible neck or breakaway ring, and which prong portion is adapted to be mounted in a hole in a mold and is such that it will break off at the frangible neck as the mold is being stripped from the work.

Still another object is to provide an insert having a mounting prong that can be removed prior to use in instances where means other than the prong is preferred for mounting the insert in a mold.

Other objects and advantages of the invention will be apparent from the following description taken in conjunction with the accompanying drawings.

DESCRIPTION OF THE DRAWINGS

FIG. 1 diagrammatically illustrates a mold having several inserts constructed in accordance with the present invention mounted therein;

FIG. 2 is an enlarged side elevational view of one of the inserts shown in FIG. 1.

FIG. 3 is a left end view of the insert shown in FIG. 2;

FIG. 4 is a right end view of the insert shown in FIG. 2, particularly illustrating the ridges or splines on the prong;

FIG. 5 is a longitudinal sectional view through the insert, taken on the line 5—5 of FIG. 2;

FIG. 6 is a fragmentary sectional view showing the insert cast in place in concrete and a bolt threaded into the insert for securing an angle iron to the insert;

FIG. 7 is a view of a modified form of insert, which has had the prong detached therefrom; and FIG. 8 is a view of a detached prong.

DESCRIPTION OF THE PREFERRED EMBODIMENT

Referring to FIG. 1, a conventional double-walled mold 2 is shown, comprising an outer section 4 and an inner section 6. Such mold may be used in casting a utility vault, burial vault, etc. A plurality of anchor type inserts 8 embodying the present invention is mounted in the mold section 6 on the concrete side thereof at locations where an anchor is desired.

Referring to FIGS. 2 and 5, the insert 8 may be made of die cast metal, or any suitable strong plastic material that is relatively inexpensive. For example, mineral filled Nylon, which will withstand at least 90 foot pounds of torque on the screw threads, has been found to be quite satisfactory and is the preferred material. The insert 8 may be injection molded or otherwise cast, and comprises a cylindrical body portion 10 surrounded by two transverse, pull-out resistant flanges 12 and 14 interconnected by reinforcing ribs 16 having edges that diverge in a direction from the flange 12 toward the flange 14. The body portion 10 extends to the right beyond the flange 12 and is further reinforced by tapered ribs 18 aligned with the ribs 16. The ribs 18 terminate short of the end 20 of the body 10. The end 20 serves as a mold abutment surface. An integral prong 22 is spaced at its inner end from the end 20 of the body 10 by a groove 23 surrounding a thin frangible neck or breakaway ring 24. The prong 22 is preferably cylindrical, as is best shown in FIG. 4, and terminates in an outer end 25. As is shown in FIG. 6, the abutment surface or end 20 of the body portion 10 is larger in outside diameter than the prong 22. A plurality of ridges or splines 26 is formed on the exterior of the prong 22 and extends for the full length thereof. The ends of the ridges adjacent the extremity 25 are beveled, as indicated at 28, to facilitate insertion thereof in an undersized opening 30 in the mold 6. While FIG. 4 shows four ridges 26, six, eight or any other suitable number can be provided, depending upon the size of the insert. In this connection, certain specific dimensions are given hereinafter as exemplary of an insert designed to receive a ½ inch (1.27 cm.) diameter cap screw, but it will be understood that the insert can be made to receive a bolt of any other size.

The body portion 8 extends to the left beyond the flange 14, as shown in FIG. 2. A rigid web 32 also extends toward the left from the flange 14 and has converging side edges that terminate in a flat end face or head 34 provided for a purpose described later. The web 32 has an opening 36 that is semicircular at its left extremity and terminates at its right extremity at the end of the extended portion of the body 10. The radius of the semicircular portion is about ⅝ of an inch (1.585 cm.) so as to readily receive a ½ inch diameter (1.27 cm.) reinforcing bar therein. In the absence of a reinforcing bar in the opening 36, concrete will fill the opening 36 and serve as a solid key adding resistance to pull-out.

The internal structure of the insert 8 is best illustrated in FIG. 5 wherefrom it will be noted that the body 10 has a plain cylindrical bore 38 extending thereinto to a point adjacent the zone of the flange 12. A threaded bore 40 lies inwardly of the plain bore 38. The frangible neck or breakaway ring 24 is relatively thin, thereby enabling the prong 22 to be readily broken away from the end 20 of the body 10.

The insert 8 is adapted to be used with a mold wall 6 having one or more openings 30 therein at a location or locations where it is desired to have an insert in the finished casting. The ridges 26 on the prong 22 are slightly oversized relative to the diameter of the opening 30 in the mold wall 6. For example, the outside diameter of the ridges may be 0.650 inch (1.651 cm.) and the diameter of the opening 30 may be 0.625 inch (1.585 cm.) for a bolt thread size of ½ inch (1.27 cm.). Further, the groove 23 has a width of 1/16 inch (0.1508 cm.) and the neck 24 has a radial thickness of 0.030 inch (0.0762 cm.).

In order to mount the insert 8 in the mold wall 6, the tapered end portion 25 of the insert is positioned in a preformed opening 30 and one or more hammer taps or blows are applied to the flat head portion 34 of the web 32 to drive the insert into the opening 30 until the body end 20 abuts the inner face of the mold. As the insert is driven into the opening 30, the ridges 26 are compressed, or are "skinned" slightly, which makes them fit very tightly in the opening 30, so that the insert 8 is firmly held and remains in place while the mold 2 is vibrated (if desired) and concrete is being poured into the mold. The prong 22 is also of relatively thin cross-section, and particularly when made of plastic material, will be contracted or compressed slightly while being forced into the opening 30.

It will be understood from the foregoing that considerable labor and time can be saved because of the fact that the insert 8 can be readily mounted in the form from the same side as that on which the concrete is to be poured. Mounting of the insert can be effected by one workman, instead of two, as is required in many instances with prior insert structures.

After the concrete has been poured into the mold 2 and has set, the inner section 6 of the mold 2 can be readily removed by partially collapsing it, i.e., moving it a very slight distance away from the cast concrete, say, about ⅛ of an inch (0.317 cm.), which is sufficient to separate the prong 22 from the body 10 of the insert by breaking the neck portion 24. The casting can then be readily lifted out of the mold 2. The prong 22 remains in the opening 30 in the mold 6, but can be easily driven out with a drift pin, thereby rendering the mold 2 ready for immediate reuse. The separated prong is illustrated in FIG. 8, and is discarded.

FIG. 6 is a fragmentary sectional view illustrating a portion of a concrete body 42 in which an insert 8 has been embedded, and to which insert an angle iron 44 is shown attached by a cap screw 46 threaded into the bore 40.

For certain purposes, the insert 8 can be used without the prong 22, in which event, the prong can be readily broken away from the body portion 10 by use of a suitable pry bar or by striking the prong with a hammer. FIG. 7 illustrates a modified insert 8A from which the prong has been separated prior to mounting the same in a mold. The insert 8A differs from the insert 8 in that the flange 12 has been omitted. The insert 8A is shown in position with its end 20A in abutment with the inner face of a mold 6A, which may be a single-walled mold such as used in constructing building walls or foundations. A reinforcing bar 48 is shown extending through an opening 36A in a web 32A similar to the web 32. In such instance, it is desirable to secure the insert 8A in position by a cap screw 50. Such mounting prevents the weight of the reinforcing bar 48 from tilting the insert 8A in the mold 6A, or causing the insert to be pulled out of its mounting opening, as might occur if a prong mounting were used.

It is to be understood that various changes may be made in the design and proportions of the present insert and in the manner of mounting the same in a mold, without departing from the principles of the invention or the scope of the annexed claims.

I claim:

1. An insert, comprising: a body portion adapted to be anchored in concrete, said body portion having circumferentially spaced longitudinally extending ribs on the exterior thereof for anchoring the same against rotation in said concrete; a prong at one end of said body portion adapted to be driven into a relatively smaller size hole in a mold prior to casting the concrete, said prong having circumferentially spaced longitudinally extending ridges on the exterior thereof to prevent rotation thereof in said hole, said one end of said body portion being larger in outside diameter than said prong and forming an abutment for engagement with said mold, said prong having a cylindrical bore which extends completely therethrough and into said body portion, said cylindrical bore having screw threads in that portion thereof which is disposed in said body portion; and readily frangible cylindrical means between said body portion and said prong, said frangible means being formed by a narrow groove at the abutment end of said body portion and axially spacing said prong from said body portion and constituting the sole connecting means between said prong and said body portion, said prong being of such design and dimensions as to be slightly contractible when driven into said relatively smaller hole in said mold.

2. An insert as claimed in claim 1, wherein the readily frangible means is an annular breakaway ring joining the prong to the body and surrounding the bore in said prong.

3. An insert as claimed in claim 1, wherein the body portion, prong, and frangible means are integrally formed to provide a unitary structure.

4. An insert as claimed in claim 1, wherein the longitudinally ridges extend from said readily frangible means to the outer end of said prong.

5. An insert as claimed in claim 4, wherein the ridges are beveled adjacent the outer end of the prong.

6. An insert as claimed in claim 1, wherein the web extends lengthwise from and beyond the other end of the body and has a flat end face for receiving hammer blows during mounting of the prong in a mold.

7. An insert as claimed in claim 1, wherein a plurality of axially spaced retaining flanges project outwardly from and surround the body portion and are interconnected by said longitudinally extending ribs which also project outwardly from said body.

8. An insert, comprising: a body portion adapted to be anchored in concrete; a prong at one end of said body portion adapted to be driven into a relativly smaller size hole in a mold, said one end of said body portion being larger in outside diameter than said prong and forming an abutment for engagement with said mold, said prong having a bore which extends completely therethrough and into said body portion, said bore having screw threads in that portion thereof which is disposed in said body portion; readily frangible means between said body portion and said prong, said frangible means being formed by a narrow groove at the abutment end of said body portion and axially spacing said prong from said body portion, said body portion, prong and frangible means being integrally formed to provide a unitary structure, said prong having an outer end, and having circumferentially spaced, longitudinal ridges on its exterior extending from said outer end toward said body portion, said ridges being beveled adjacent said outer end of said prong; a retaining flange projecting outwardly from and surrounding said body portion adjacent the end thereof remote from said prong; and a web extending lengthwise from said flange and beyond said body portion and having a flat face for receiving hammer blows during mounting of the prong in said opening in said mold.

9. An insert as claimed in claim 8, including a second flange surrounding and projecting from said body portion located adjacent the end thereof nearest to said prong; and a plurality of circumferentially spaced, longitudinal ribs projecting outwardly from said body portion and interconnecting said retaining flange and said second flange.

* * * * *